US009033332B2

(12) United States Patent
Sato et al.

(10) Patent No.: US 9,033,332 B2
(45) Date of Patent: May 19, 2015

(54) SHEET CONVEYING DEVICE WITH STOPPER

(75) Inventors: Kuniaki Sato, Inagi (JP); Kazuyuki Morinaga, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/316,780

(22) Filed: Dec. 12, 2011

(65) Prior Publication Data

US 2012/0161383 A1 Jun. 28, 2012

(30) Foreign Application Priority Data

Dec. 28, 2010 (JP) ..... 2010-293808

(51) Int. Cl.

| | |
|---|---|
| ***B65H 3/52*** | (2006.01) |
| ***B65H 3/06*** | (2006.01) |
| ***B65H 5/06*** | (2006.01) |
| ***G03G 15/00*** | (2006.01) |
| ***B65H 3/56*** | (2006.01) |

(52) U.S. Cl.

CPC ..... *B65H 3/0669* (2013.01); *B65H 3/0684* (2013.01); *B65H 5/062* (2013.01); *B65H 2403/422* (2013.01); *B65H 2403/481* (2013.01); *B65H 2403/721* (2013.01); *B65H 2801/06* (2013.01); *B65H 2801/39* (2013.01); *G03G 15/602* (2013.01); *B65H 2301/4222* (2013.01); *B65H 3/56* (2013.01)

(58) Field of Classification Search

CPC ..... B65H 3/34; B65H 3/56; B65H 9/06
USPC ..... 271/10.11, 10.12, 121, 122, 245, 246
See application file for complete search history.

(56) References Cited

U.S. PATENT DOCUMENTS

| | | | | |
|---|---|---|---|---|
| 5,398,108 | A | 3/1995 | Morinaga et al. | |
| 5,571,265 | A | 11/1996 | Yagi et al. | |
| 5,722,654 | A | 3/1998 | Sootome et al. | |
| 6,113,093 | A | 9/2000 | Morinaga et al. | |
| 6,651,972 | B2 * | 11/2003 | Hsiao et al. | 271/114 |
| 6,674,976 | B2 | 1/2004 | Sato et al. | |
| 7,530,563 | B2 * | 5/2009 | Kuo | 271/124 |
| 7,595,916 | B2 * | 9/2009 | Morimoto et al. | 358/474 |
| 7,621,522 | B2 * | 11/2009 | Yasukawa et al. | 271/121 |
| 8,047,533 | B2 * | 11/2011 | Kuo | 271/121 |
| 8,052,137 | B2 * | 11/2011 | Chung et al. | 271/117 |
| 8,118,299 | B2 * | 2/2012 | Sato | 271/118 |
| 2001/0040338 | A1 * | 11/2001 | Kuo et al. | 271/245 |

(Continued)

FOREIGN PATENT DOCUMENTS

JP 06-305595 11/1994

*Primary Examiner* — Jeremy R Severson
(74) *Attorney, Agent, or Firm* — Fitzpatrick, Cella, Harper & Scinto

(57) ABSTRACT

The present invention provide a sheet conveying device comprising a driving source which freely rotates in a forward/reverse direction, a separation roller shaft configured to drive a separation roller to separate and feed each sheet to be conveyed in accordance with forward/reverse rotation of the driving source, a stopper unit configured to close a conveyance path of stacked sheets on an upstream side of the separation roller in a conveyance direction, a stopper opening/closing member configured to open/close the stopper unit in a vertical direction, and a transfer unit provided between the stopper opening/closing member and the separation roller shaft and configured to transfer a rotating force to the stopper opening/closing member in accordance with a drive of the separation roller shaft.

4 Claims, 10 Drawing Sheets

(56) References Cited

U.S. PATENT DOCUMENTS

2002/0175462 A1* 11/2002 Sonoda et al. ..... 271/121
2004/0071486 A1* 4/2004 Manabe et al. ..... 399/367
2010/0259801 A1* 10/2010 Cheng ..... 358/498
2010/0295234 A1* 11/2010 Liu ..... 271/8.1
2011/0140354 A1 6/2011 Tokisawa et al.
2013/0241139 A1* 9/2013 Hayakawa ..... 271/117

* cited by examiner

FIG. 7A
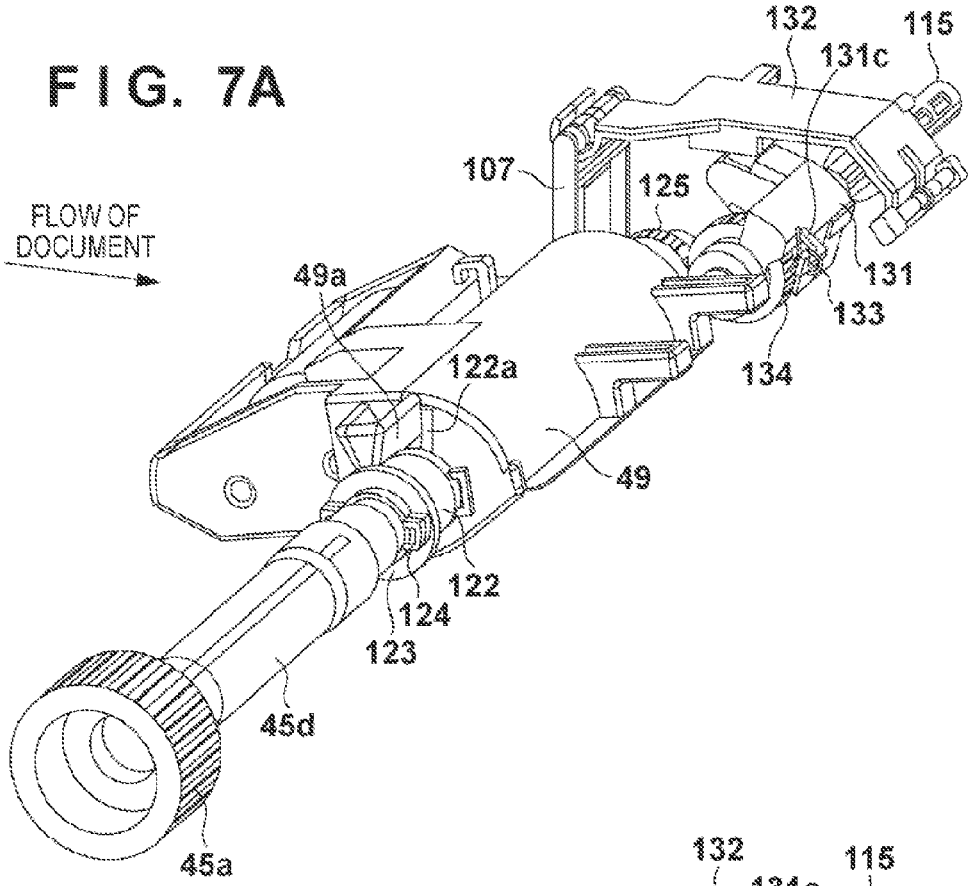
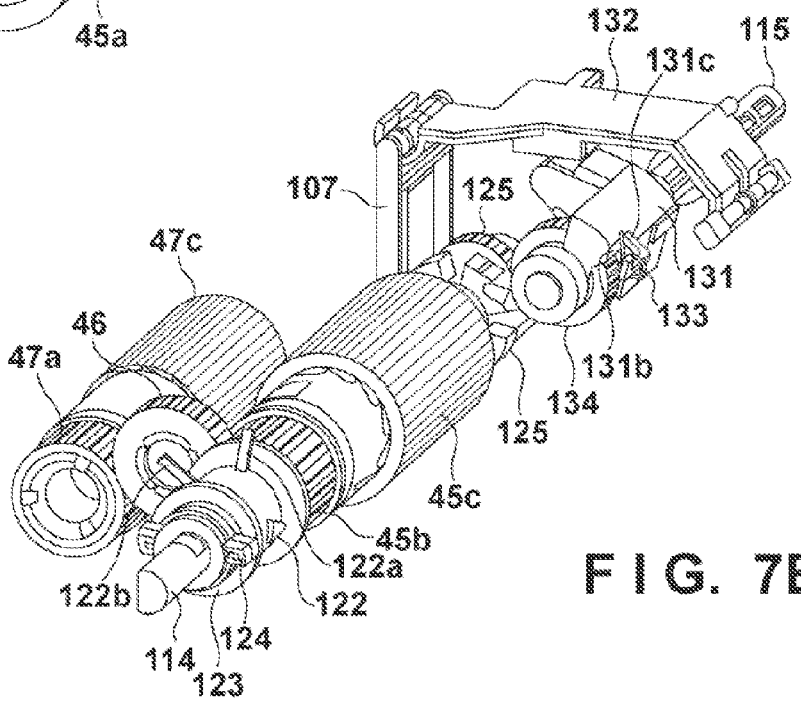
FIG. 7B

SHEET CONVEYING DEVICE WITH STOPPER

BACKGROUND OF THE INVENTION

1. Field of the Invention

The present invention relates to a sheet conveying device for conveying a sheet.

2. Description of the Related Art

There exists a sheet conveying device which causes a pickup roller to feed document sheets or the like stacked on a stacking table and a sheet separating section including a separation roller and a separation pad to separate each sheet, and then feeds it to an image reading apparatus. Some sheet conveying devices of this type have a stopper between the pickup roller and the sheet separating section to limit feeding of the sheets stacked on the stacking table. For example, Japanese Patent Laid-Open No. 6-305595 discloses a technique of extracting a rotating force from the separation shaft with the separation roller fixed on it, and transferring the rotating force to a swing lever via a clutch spring to make the lever pivot, thereby causing a driving shaft with the stopper fixed on it to pivot following the pivotal movement of the swing lever.

In the technique disclosed in Japanese Patent Laid-Open No. 6-305595, however, the stopper needs to be driven against the self weight of the sheets stacked on the stacking table. To do this, it is necessary to increase the drag torque of the clutch spring and also increase the driving torque of the driving source. The load on the stopper becomes heavier especially when a number of sheets are stacked on the stacking table.

SUMMARY OF THE INVENTION

The present invention provides a mechanism for more reliably opening/closing a stopper configured to open/close the conveyance path of stacked sheets while reducing the driving load upon the stopper opening/closing operation.

According to an aspect of the present invention, there is provided a sheet conveying device comprising: a driving source which freely rotates in a forward/reverse direction; a separation roller shaft configured to drive a separation roller to separate and feed each sheet to be conveyed in accordance with forward/reverse rotation of the driving source; a stopper unit configured to close a conveyance path of stacked sheets on an upstream side of the separation roller in a conveyance direction; a stopper opening/closing member configured to open/close the stopper unit in a vertical direction; and a transfer unit provided between the stopper opening/closing member and the separation roller shaft and configured to transfer a rotating force to the stopper opening/closing member in accordance with a drive of the separation roller shaft.

Further features of the present invention will become apparent from the following description of exemplary embodiments (with reference to the attached drawings).

BRIEF DESCRIPTION OF THE DRAWINGS

FIGS. 7A and 7B are perspective views showing a sheet separating section;

DESCRIPTION OF THE EMBODIMENTS

The embodiment of the present invention will now be described in detail by way of example with reference to the accompanying drawings. Note that in some cases, an image reading apparatus is provided and used in the main body of an image recording apparatus such as a copying machine, a printer, a facsimile apparatus, or a multi function peripheral including them as part of the constituent elements of the image recording apparatus. In this case, information read by the image reading apparatus is recorded as an image on a sheet by the image recording section (image recording means) of the image recording apparatus. That is, the image read by the image reading apparatus is copied to a sheet by the image recording section. The sizes, materials, shapes, and relative arrangements of the constituent components described in the following embodiment should properly be changed depending on various conditions and the arrangement of the apparatus to which the present invention is applied, and the present invention is not limited to the scope.

In this embodiment, an automatic feeding and reading apparatus will be exemplified, which serves as an image reading apparatus including a sheet conveying device to which the present invention is applied.

<Overall Arrangement>

Figure 1:
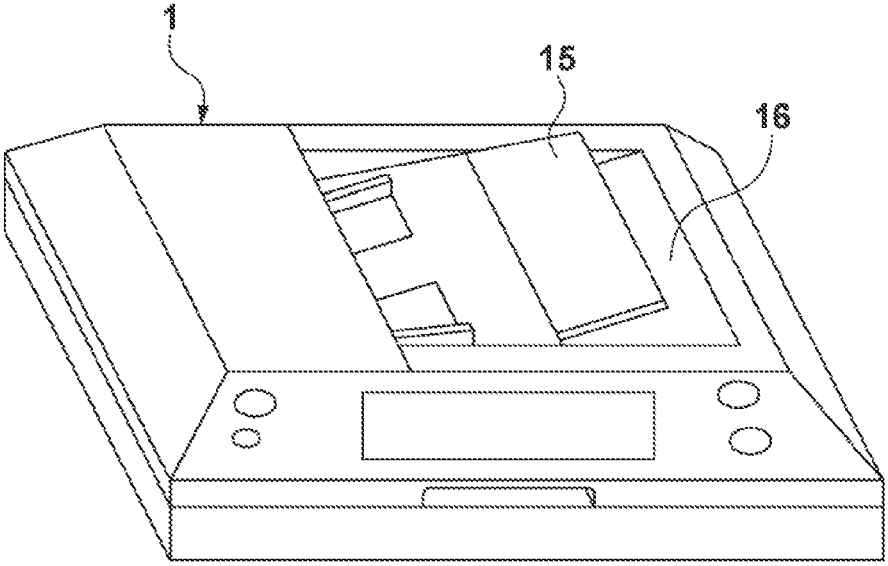
FIG. 1 is a perspective view showing the outer appearance of an automatic feeding and reading apparatus according to an embodiment of the present invention.
Figure 2:
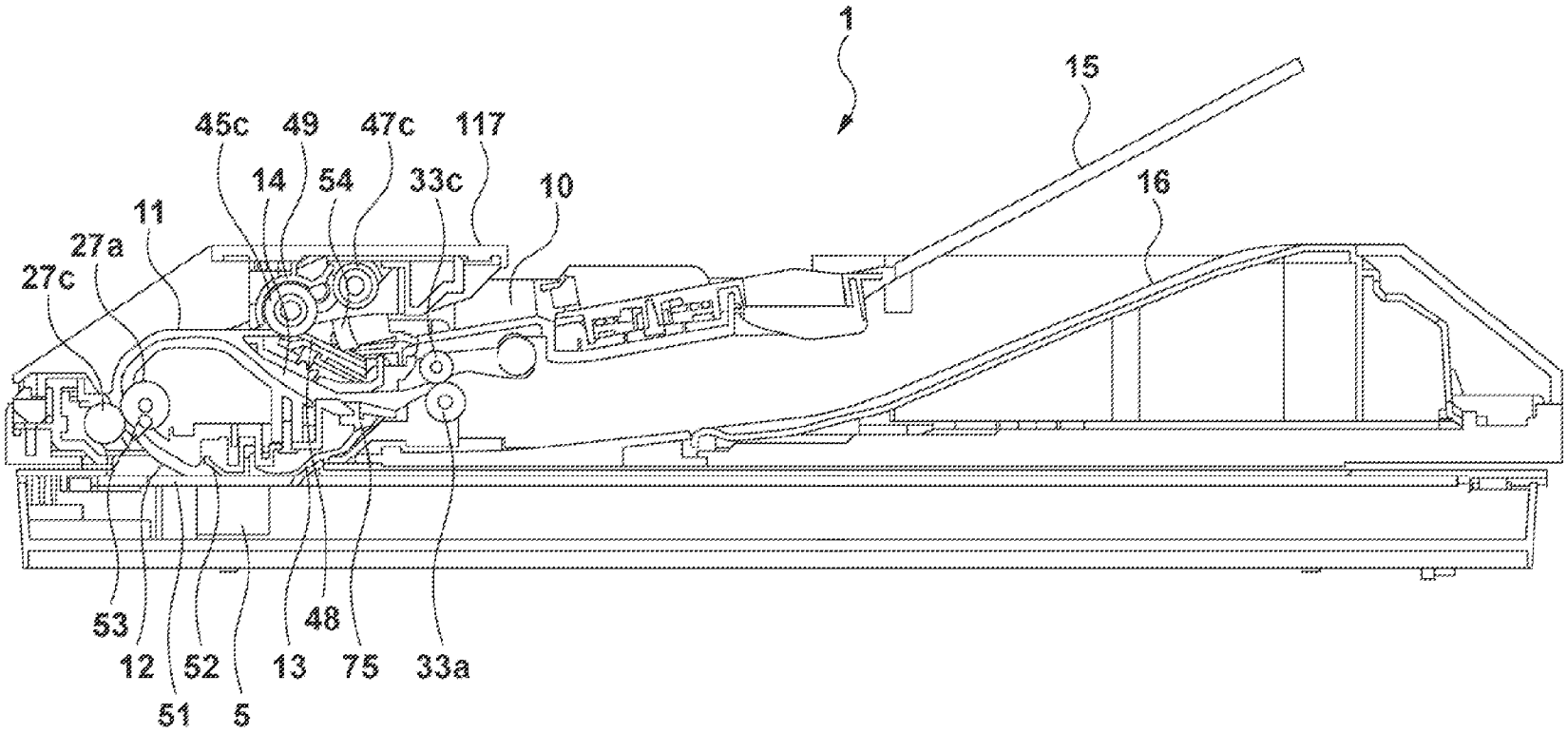
FIG. 2 is a sectional view showing the schematic arrangement of the automatic feeding and reading apparatus.
Figure 3:
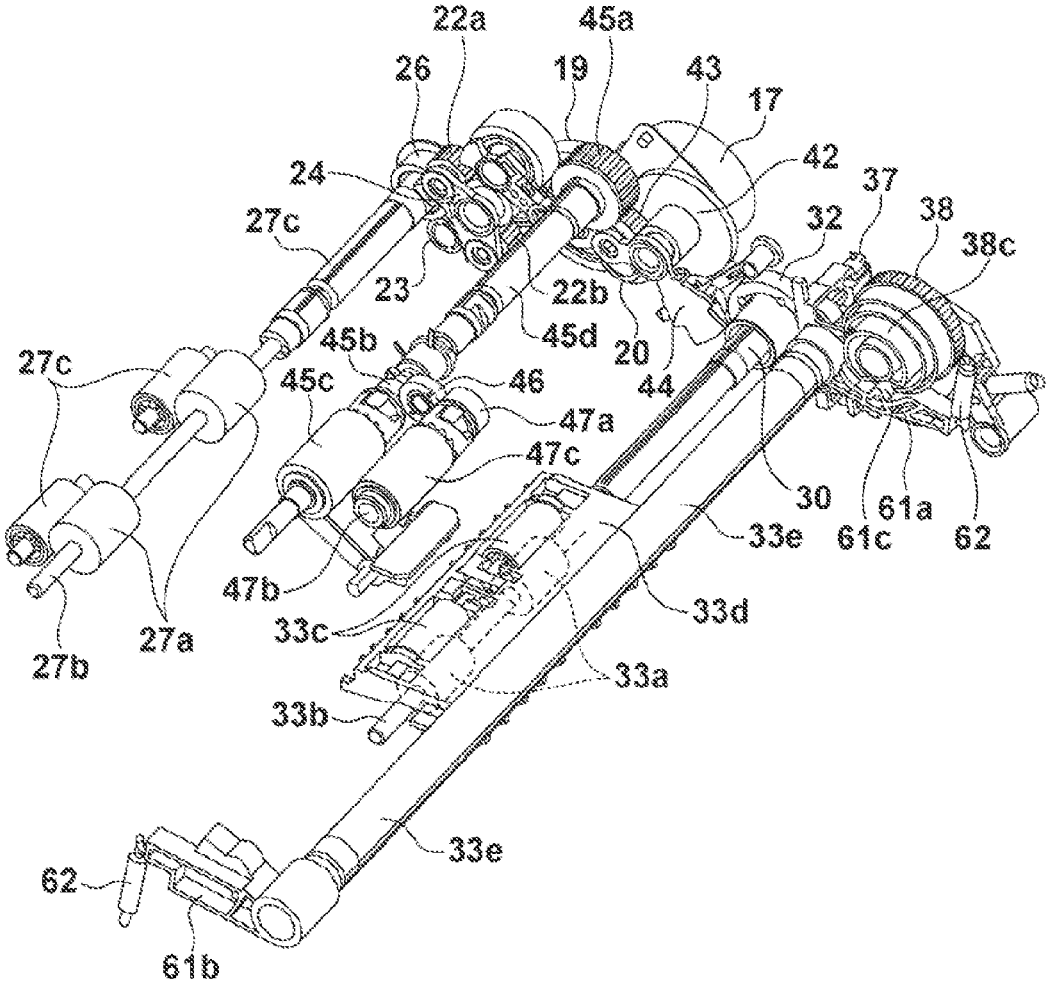
FIG. 3 is a perspective view showing the rollers and the chain of driving gears of the automatic feeding and reading apparatus.

FIG. 1 is a perspective view showing the outer appearance of the automatic feeding and reading apparatus according to this embodiment. FIG. 2 is a sectional view showing the schematic arrangement of the automatic feeding and reading apparatus according to this embodiment. FIG. 3 is a perspective view showing the rollers and the chain of driving gears of the automatic feeding and reading apparatus. First, the arrangement of the automatic feeding and reading apparatus will be explained with reference to FIGS. 1 to 3.

An automatic feeding and reading apparatus 1 includes a document feed tray 15 provided on the apparatus, and a document discharge tray 16 provided under the document feed tray 15. A document feed path 10 (conveyance path), a document conveyance path 11, a document reading path 12, and a document discharge path 13 are sequentially arranged in an almost U shape between the document feed tray 15 and the document discharge tray 16.

A document reversing path 14 is provided between the document feed path 10 and the document reading path 12. The document reversing path 14 connects the document discharge path 13 and the document conveyance path 11. A path switching flapper 75 is disposed between the document discharge path 13 and the document reversing path 14.

The path switching flapper 75 is configured to be swingable and face up so as to open the document discharge path 13 or face down so as to open the document reversing path 14. The path switching flapper 75 normally faces down due to the weight of its own.

The document feed path 10 includes a pickup roller 47*c* that feeds stacked sheets, and a separation roller 45*c* that separately feeds each of the conveyed sheets. A separation pad 48 contacts the lower portion of the separation roller 45*c* due to the action of a spring (not shown). A document presence/absence sensor 54 exists in the document feed tray 15 or the document feed path 10 to detect a document stacked on the document feed tray 15.

The document conveyance path 11 includes conveyance rollers 27*a*. Conveyance idler rollers 27*c* rotatably contact the conveyance rollers 27*a* due to the action of a spring (not shown). A document reading platen glass 51 is provided under the document reading path 12. A document reading section 5 is provided under the document reading platen glass 51. A document pressing member 52 is provided on the document reading platen glass 51. A document is conveyed between the document reading platen glass 51 and the document pressing member 52.

In the document reading section 5, the conveyed document (sheet) is irradiated with light from a light source such as an LED via the document reading platen glass 51. A lens array condenses the reflected light. A contact image sensor (to be referred to as a CIS hereinafter) then causes a reading means such as a CCD to photoelectrically convert the light, thereby reading the document image.

The document discharge path 13 includes discharge rollers 33*a*. Discharge idler rollers 33*c* are rotatably supported by a discharge idler roller holder 33*d* and contact the discharge rollers 33*a*. The discharge idler roller holder 33*d* includes a shaft portion 33*e* and is pivotally supported about the shaft portion 33*e* so as to be swingable.

Discharge idler roller holder levers 61*a* and 61*b* are attached to the two ends of the shaft portion 33*e*. Hooks are provided at the distal ends of the discharge idler roller holder levers 61*a* and 61*b*. A spring 62 is attached to each hook. The springs 62 are attached such that the spring force acts to swing the discharge idler roller holder 33*d* toward the discharge rollers 33*a* so as to press the discharge idler rollers 33*c* against the discharge rollers 33*a*.

A cam follower 61*c* engaging with a cam face 38*c* of a discharge cam gear 38 to be described later is provided on the discharge idler roller holder lever 61*a* on the side of the chain of drives.

Figure 4:
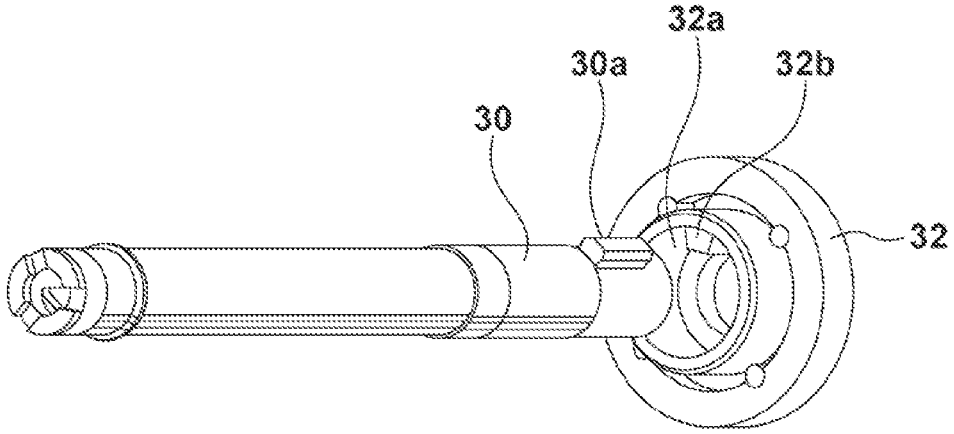
FIG. 4 is a perspective view for explaining a delaying mechanism.
Figure 5:
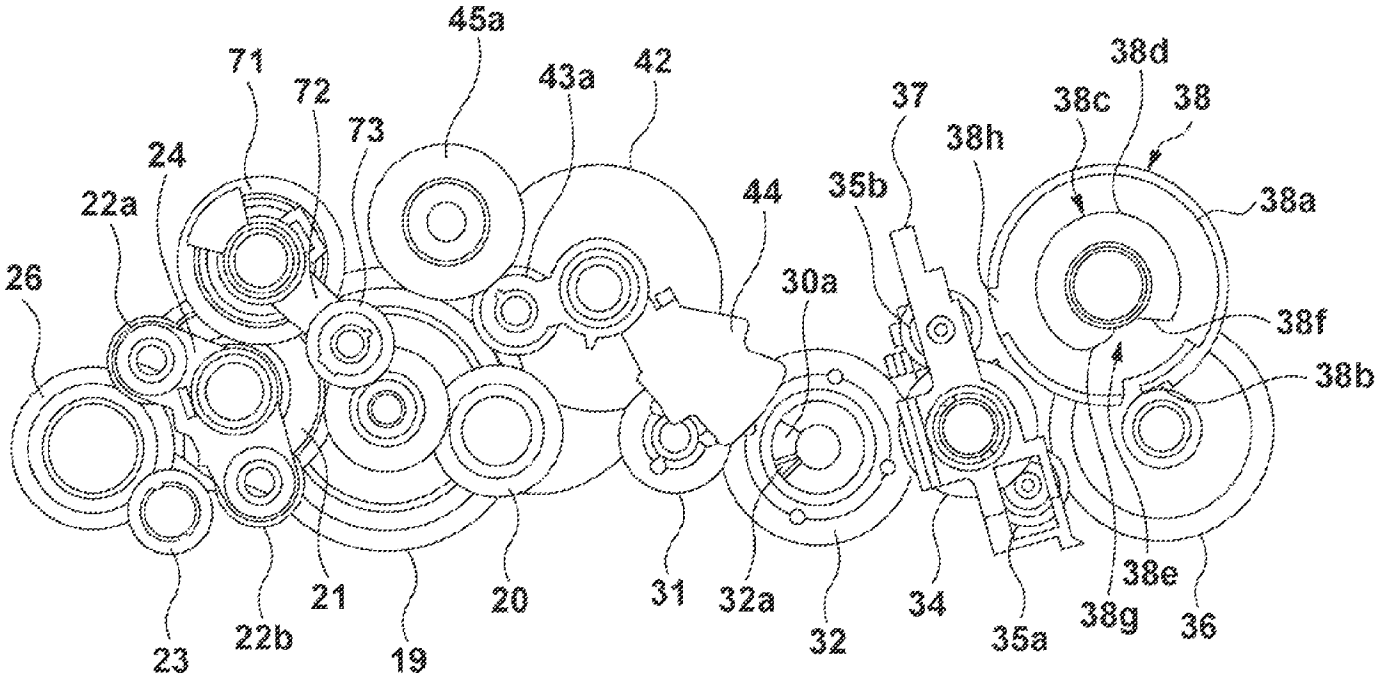
FIG. 5 is a schematic view showing a chain of drives when the motor rotates in the forward direction.
Figure 6:
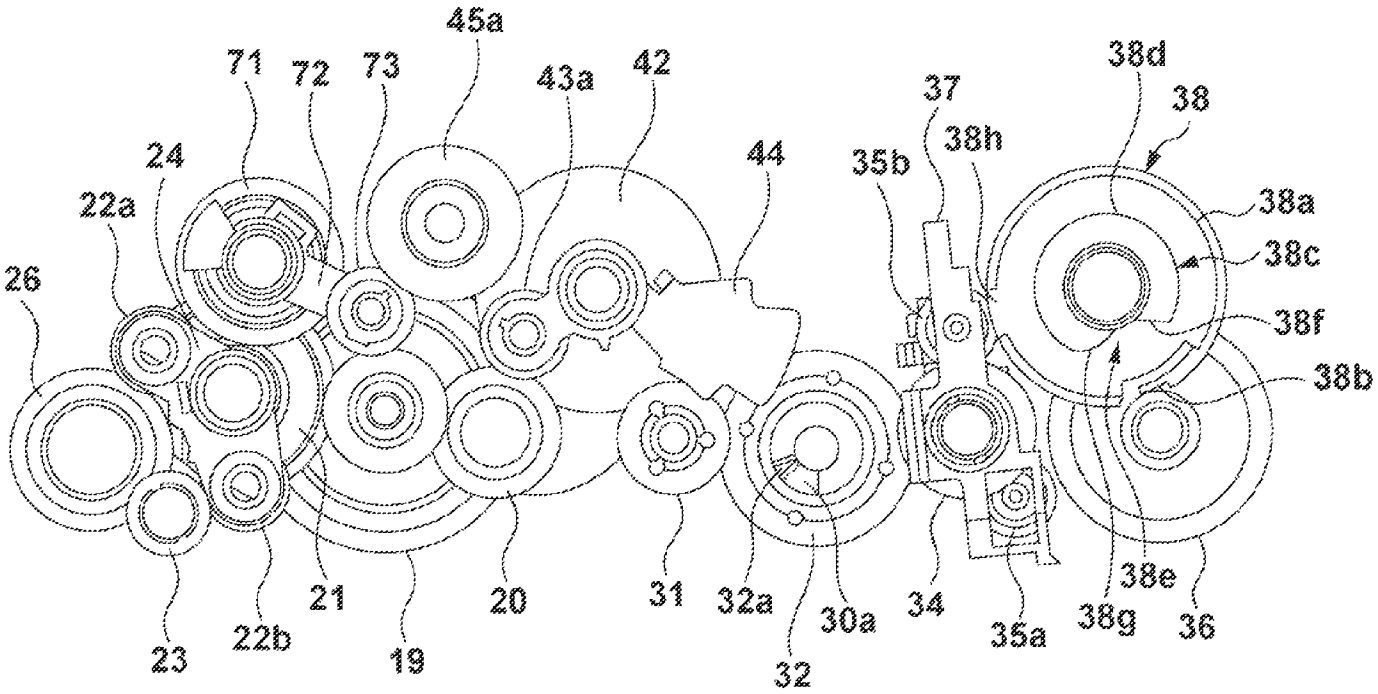
FIG. 6 is a schematic view showing the chain of drives when the motor rotates in the reverse direction.

FIG. 4 is a perspective view for explaining a delaying mechanism. FIG. 5 is a schematic view showing a chain of gears when the motor of the automatic feeding and reading apparatus according to this embodiment rotates in the forward direction. FIG. 6 is a schematic view showing the chain of gears when the motor of the automatic feeding and reading apparatus according to this embodiment rotates in the reverse direction. The arrangement of the chain of drives for feeding documents according to this embodiment will be described with reference to FIGS. 3 to 6.

A chain 2 of drives for feeding documents includes a motor 17 serving as the sole (single) driving source of the chain 2 of drives for feeding documents and capable of rotating in the forward and reverse directions. A motor gear (not shown) is attached to the motor 17. The motor gear meshes with a conveyance sun gear 21 through an idler gear 19. A conveyance planet gear arm 24 swingable about the axis is attached to the conveyance sun gear 21. Conveyance planet gears 22*a* and 22*b* are rotatably attached to the conveyance planet gear arm 24 to as to mesh with the conveyance sun gear 21. As the conveyance sun gear 21 and the conveyance planet gear arm 24 swing, the conveyance planet gear 22*a* meshes with a conveyance roller gear 26, and the conveyance planet gear 22*b* meshes with a conveyance planet-idler gear 23. The conveyance planet-idler gear 23 meshes with the conveyance roller gear 26. The conveyance rollers 27*a* are coaxially fixed on a conveyance roller shaft 27*b*. The conveyance roller gear 26 is coaxially supported at an end of the conveyance roller shaft 27*b* so as to mesh with the conveyance planet-idler gear 23.

The discharge rollers 33*a* are coaxially fixed on a discharge roller shaft 33*b*. A discharge roller driving shaft 30 is coaxially supported at an end of the discharge roller shaft 33*b*. A discharge roller gear 32 faces the discharge roller driving shaft 30 and freely fits on the discharge roller shaft 33*b* so as to be rotatable. A protruding portion 30*a* is provided on the discharge roller driving shaft 30. The protruding portion 30*a* is formed to protrude toward the discharge roller gear 32 in the axial direction. The discharge roller gear 32 has a concave portion 32*a* that receives the protruding portion 30*a*, and a protruding portion 32*b* formed to be concyclic with the concave portion and engage with the protruding portion 30*a*.

The circumferential length of the concave portion 32*a* is set to be longer than that of the protruding portion 30*a*. For this reason, the discharge roller driving shaft is at rest until the protruding portions 30*a* and 30*b* engage with each other, and is then driven with a delay with respect to the rotation of the discharge roller gear 32. That is, when the rotation direction of the discharge roller gear 32 is switched, the driving force is transferred to the discharge rollers 33*a* with a delay. Hence, the discharge rollers 33*a* always start moving with a delay of a predetermined time. The mechanism that is formed from the discharge roller driving shaft 30 and the discharge roller gear 32 and moves as described above will be referred to as a delaying mechanism hereinafter.

The discharge roller gear 32 meshes with a discharge cam sun gear 34. A discharge cam planet gear arm 37 swingable about the axis is attached to the discharge cam sun gear 34. Discharge cam planet gears 35*a* and 35*b* are rotatably attached to the discharge cam planet gear arm 37. The discharge cam sun gear 34 meshes with the discharge cam planet gears 35*a* and 35*b*.

As the discharge cam sun gear 34 rotates, the discharge cam planet gear arm 37 swings. That is, the discharge cam planet gear arm 37 swings to make the discharge cam planet gear 35*a* mesh with a discharge cam planet idler gear 36 when the motor 17 rotates in the forward direction and make the discharge cam planet gear 35*b* mesh with the discharge cam gear 38 when the motor 17 rotates in the reverse direction. The discharge cam gear 38 has untoothed portions 38*a* and 38*b*. In the initial state, the untoothed portion 38*b* faces the discharge cam planet idler gear 36. Even when the motor 17 rotates in the forward direction, the teeth do not mesh with each other. Hence, the drive of the discharge cam planet idler gear 36 is not transferred to the discharge cam gear 38.

On the other hand, the discharge cam gear 38 has a gear portion 38*h* corresponding to a predetermined number of teeth at a position facing the discharge cam planet gear 35*b*, and the untoothed portion 38*a* otherwise. When the motor 17 rotates in the reverse direction, the discharge cam sun gear 34 rotates to swing the discharge cam planet gear arm 37. The gear portion of the discharge cam gear 38 meshes with the discharge cam planet gear 35*b* so as to rotatably drive the discharge cam gear 38 by an amount corresponding to the predetermined number of teeth. After that, when the discharge cam planet gear 35*b* reaches the untoothed portion 38*a*, transfer of the drive from the motor to the discharge cam gear 38 stops, and the discharge cam gear 38 stops rotating. At this time, since the discharge cam gear 38 rotates by the amount corresponding to the several teeth, the untoothed portion 38*b* at the position facing the discharge cam planet idler gear 36 moves and meshes with the gear portion 38*h*.

When the rotation of the motor 17 is then switched to the forward direction, the discharge cam planet gear arm 37 swingably rotates to make the discharge cam planet gear 35*a* mesh with the discharge cam planet idler gear 36 and rotatably drive the discharge cam planet idler gear 36. Since the discharge cam planet idler gear 36 meshes with the discharge cam gear 38 this time, the discharge cam gear 38 is rotatably driven. After that, the discharge cam gear 38 is rotatably driven until the discharge cam planet idler gear 36 reaches the untoothed portion 38*b*. Transfer of the drive to the discharge cam gear 38 stops when the untoothed portion 38*b* reaches the position facing the discharge cam planet idler gear 36. The discharge cam gear 38 stops, thus restoring the initial state.

The discharge cam gear 38 has the cam face 38*c*. The above-described cam follower 61*c* of the discharge idler roller holder lever 61*a* is arranged at the position facing the cam face 38*c*. The cam face 38*c* includes an arc portion 38*d* concentric to the discharge cam gear 38, and a concave portion 38*e* connected to the arc portion 38*d* via inclined surfaces 38*f* and 38*g*.

In the initial state, the concave portion 38*e* is located at the position facing the cam follower 61*c*, and the cam face 38*c* and the cam follower 61*c* are in a disengaged state. When the discharge cam gear 38 rotates, the inclined surface 38*f* of the cam face 38*c* engages with the cam follower 61*c* and starts pushing the discharge idler roller holder lever 61*a* down against the spring force of the spring 62.

This makes the discharge idler roller holder 33*d* pivot about the shaft portion 33*e* so the discharge idler rollers 33*c* start gradually separating from the discharge rollers 33*a*. The pivotal movement of the discharge idler roller holder 33*d* ends when the cam follower 61*c* reaches the arc portion 38*d* of the cam face 38*c*, thus completing the separation operation between the discharge rollers 33*a* and the discharge idler rollers 33*c*.

When the discharge cam gear 38 further rotates, the inclined surface 38*g* engages with the cam follower 61*c*. The discharge idler roller holder lever 61*a* is moved upward by the spring force so as to make a movement reverse to that described above. After a while, the discharge rollers 33*a* are pressed against the discharge idler rollers 33*c*, and the cam face 38*c* disengages from the cam follower 61*c*, thus restoring the initial state.

The idler gear 19 meshes with a feeding sun gear 42 via an idler gear 20. A feeding planet gear 43 is rotatably attached to a feeding planet gear arm 44. The feeding planet gear arm 44 swingable about the axis is attached to the feeding sun gear 42 and meshes with the feeding sun gear 42. When the motor 17 rotates in the forward direction, the feeding sun gear 42 swings to make a separation roller gear 45*a* mesh with the feeding planet gear 43. A separation roller shaft 45*d* is coaxially fixed at the rotation center of the separation roller gear 45*a*.

A separation roller 45*c* and a separation roller gear 45*b* are coaxially fixed on the separation roller shaft 45*d* on the side of the document feed path 10. A pickup gear 47*a* meshes with the separation roller gear 45*b* via a pickup idler gear 46. A pickup roller 47*c* is coaxially fixed at the rotation center of the pickup gear 47*a* via a pickup shaft 47*b*.

A pickup holder 49 (see FIG. 7A) integrally supports the pickup gear 47*a*, the pickup shaft 47*b*, the pickup roller 47*c*, and the pickup idler gear 46. A spring clutch (not shown) is attached across the pickup holder 49 and the separation roller shaft 45*d*.

A feeding sun gear 71 meshes with the conveyance roller gear 26. A feeding planet gear arm 72 swingable about the axis is attached to the feeding sun gear 71. A feeding planet gear 73 is attached to the feeding planet gear arm 72 and meshes with the feeding sun gear 71. When the motor 17 rotates in the forward direction, the feeding sun gear 71 swings to make the separation roller gear 45*a* mesh with the feeding planet gear 73.

<Detailed Arrangement of Sheet Separating Section>

Figure 8:
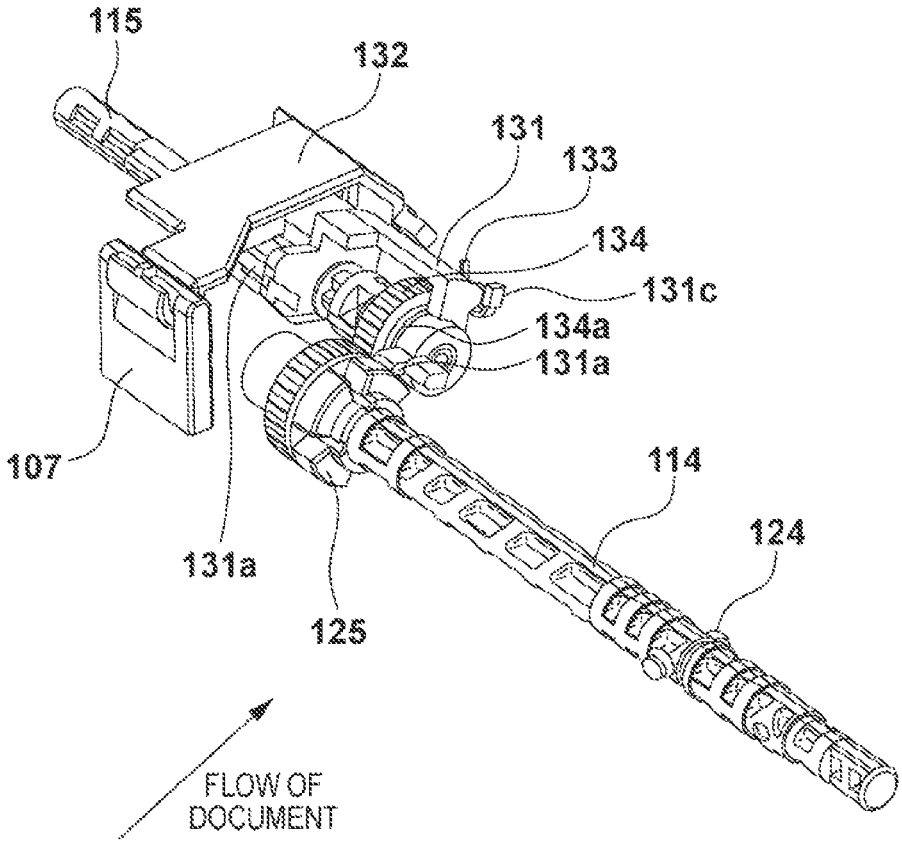
FIG. 8 is a perspective view showing a stopper driving mechanism out of the sheet separating section.

FIG. 7A is a perspective view of the sheet separating section. FIG. 7B does not illustrate the separation roller gear 45*a* and the pickup holder 49 in FIG. 7A. FIG. 8 is a perspective view of a stopper driving mechanism out of the sheet separating section. The sheet separating section has the arrangement shown in FIG. 7A, and separates and feeds, at a predetermined timing, the sheets stacked on the stacking table. The predetermined timing means the timing the stopper driving mechanism opens a document stopper 107 serving as a stopper member.

The separation roller shaft 45*d* is coaxially fixed at the rotation center of the separation roller gear 45*a*. The separation roller shaft 45*d* is coaxially connected to a second separation roller shaft 114.

A stopper switching cam gear 125 serving as the first gear and cam is coaxially fixed on the second separation roller shaft 114. A separation collar 123, a clutch spring 122, and the pickup holder 49 are sequentially disposed between the separation roller gear 45*a* and the stopper switching cam gear 125. In the pickup holder 49, the separation roller gear 45*b* and the separation roller 45*c* are fitted on the second separation roller shaft 114. The pickup roller 47*c* and the pickup gear 47*a* are fitted on the pickup shaft 47*b* (see FIG. 3) whose axis is supported by the pickup holder 49. In addition, the pickup idler gear 46 whose axis is supported by the pickup holder 49 is disposed so as to mesh with the separation roller gear 45*b* and the pickup gear 47*a*.

Each of the separation roller shaft 45*d* and the second separation roller shaft 114 has a through hole to receive a pin 124. The pin 124 is inserted into the through holes of the separation roller shaft 45*d* and the second separation roller shaft 114, and in this state, axially accommodated in the groove of the separation collar 123. That is, the pin 124 makes the separation roller shaft 45*d*, the second separation roller shaft 114, and the separation collar 123 integrally rotate. For this reason, when the separation roller gear 45*a* rotates, the separation roller shaft 45*d*, the second separation roller shaft 114, the stopper switching cam gear 125, the pin 124, and the separation collar 123 integrally rotate.

The pickup holder 49 is not fixed on the second separation roller shaft 114. That is, the pickup holder 49 has clearance holes, and the second separation roller shaft 114 is inserted into the clearance holes. The pickup holder 49 has a protruding portion 49*a* protruding outward in the radial direction of the clutch spring 122. The coil-like clutch spring 122 is tightly wound around the separation collar 123. The two ends of the wire rod of the clutch spring 122 form two arm portions 122*a* and 122*b* protruding outward in the radial direction. The arm portions 122*a* and 122*b* are spaced apart by a predetermined angle.

When the separation roller gear 45*a* rotates counterclockwise, the separation collar 123 integrally rotates counterclockwise. The clutch spring 122 wound around the separation collar 123 also rotates counterclockwise. When the arm portion 122*a* of the clutch spring 122 contacts the protruding portion 49*a* of the pickup holder 49, the pickup holder 49 starts pivoting counterclockwise. When the pickup roller 47*c* attached to the pickup holder 49 contacts a document G, the pickup holder 49 cannot rotate any more, and the arm portion 122*a* of the clutch spring 122 also stops. When the separation collar 123 rotates counterclockwise in the state in which the arm portion 122*a* is at rest, the coil-like clutch spring 122 loosens on the separation collar 123. In this state, the separation collar 123 rotates counterclockwise while sliding against the clutch spring 122 and thus applies a predetermined torque to the pickup holder 49 via the arm portion 122*a*. This torque generates the press force of the pickup roller 47*c* against the document G.

On the other hand, when the separation roller gear 45*a* rotates clockwise, the separation collar 123 integrally rotates clockwise. The clutch spring 122 wound around the separation collar 123 also rotates clockwise. When the arm portion 122*b* of the clutch spring 122 contacts the protruding portion 49*a* of the pickup holder 49, the pickup holder 49 starts pivoting clockwise. When the pickup holder 49 rises on the side of the pickup roller 47*c* and hits the upper inner wall (for example, a paper feed cover 117) of the main body of the automatic feeding and reading apparatus 1, the pickup holder 49 cannot pivot any more clockwise, and the pivotal movement of the arm portion 122*b* also stops. When the separation collar 123 rotates clockwise in the state in which the arm portion 122*b* is at rest, the coil-like clutch spring 122 loosens on the separation collar 123. The separation collar 123 rotates clockwise while sliding against the clutch spring 122. The pickup holder 49 stops while remaining raised.

As described above, the two arm portions 122*a* and 122*b* are formed by the two ends of the wire rod of one coil-like clutch spring 122. The separation collar 123 is rotated to make one of the arm portions abut against the protruding portion 49*a*, thereby rotating the pickup holder 49. When the pickup holder 49 pivots up to the movable limit, the separation collar 123 rotates while sliding against the clutch spring 122 and continuously applies a predetermined torque to the pickup holder 49. Hence, the clutch spring 122 constitutes a torque limiter of forward/reverse rotation using a simple arrangement at a low cost.

A stopper opening/closing member 131 has a hole (so-called clearance hole) having a play with respect to the diameter of a shaft 115. The shaft 115 serving as the second shaft different from the second separation roller shaft 114 is inserted into the clearance hole. A stopper opening/closing switching gear 134 serving as the second gear is fixed on the shaft 115. The stopper opening/closing switching gear 134 meshes with the teeth of the stopper switching cam gear 125 to transfer the rotation force. A biasing spring 133 serving as a biasing member is provided between the stopper opening/closing member 131 and the stopper opening/closing switching gear 134. For example, a helical spring, a metal plate member, or the like is usable as the biasing spring 133. In this embodiment, the stopper opening/closing switching gear 134 is fixed on the shaft 115 so that they rotate integrally. However, the stopper opening/closing switching gear 134 may simply be inserted into a clearance hole with a play.

Further description will be made with reference to FIG. 9A in addition to FIGS. 7A, 7B, and 8. The biasing spring 133 is a helical torsion spring whose coil portion is fitted with a play on a bracket 131*c* formed on the stopper opening/closing member 131. One arm portion 133*a* of the biasing spring 133 contacts a contact portion 131*b* of the stopper opening/closing member 131. The other arm portion 133*b* of the biasing spring 133 contacts the peripheral surface of a boss portion 134*a* formed on the stopper opening/closing switching gear 134. The biasing force of the biasing spring 133 presses the arm portion 133*b* against the boss portion 134*a*. When the arm portion 133*b* is pressed against the boss portion 134*a* by the biasing of the biasing spring 133, the arm portion 133*b* receives the frictional force from the rotating boss portion 134*a*, and the stopper opening/closing member 131 receives the rotating force in the same direction as that of the stopper opening/closing switching gear 134. That is, the biasing spring 133 constitutes a frictional clutch that transfers the rotating force of the stopper opening/closing switching gear 134 to the stopper opening/closing member 131. However, when the torque necessary for the stopper opening/closing member 131 to pivot is equal to or larger than the torque generated by the biasing force of the biasing spring 133, the arm portion 133*b* slides against the rotating boss portion 134*a*, and the stopper opening/closing member 131 cannot pivot.

The stopper switching cam gear 125 includes a gear and a cam. In this embodiment, the cam is arranged adjacent to the gear and integrated with it. The cam has, in a peripheral surface 125*a* (see FIG. 9B), a plurality of grooves 125*b* (see FIG. 9C) that are recessed in the radial direction. The grooves 125*b* are formed into a shape capable of locking a protruding portion 131*a*. In this embodiment, four grooves 125*b* are provided at an equal interval in the outer surface 125*a*. When the grooves 125*b* lock the protruding portion 131*a* of the stopper opening/closing member 131, and the cam further rotates in this state, the rotating force of the cam is transferred to the stopper opening/closing member 131. Note that the cam of the stopper switching cam gear 125 need only transfer the rotating force to the protruding portion 131*a* at a predetermined timing, and the shape of the cam is determined in accordance with the timing of transfer.

An arm member 132 supports the document stopper 107 on one end side (the distal end, in this embodiment), and has the pivotal support on the other end side. That is, the arm member 132 has the proximal end pivotally axially supported by the main body of the automatic feeding and reading apparatus 1 and the distal end running up to the opposite side of the shaft 115 so as to suspendibly support the document stopper 107. The arm member 132 is thus disposed across above the stopper opening/closing member 131 and partially supported by the stopper opening/closing member 131 to determine the position of the document stopper 107.

The document stopper 107 displaces the arm member 132 in the vertical direction in accordance with the rotation drive of the stopper opening/closing member 131, thereby opening/closing the conveyance path of the stacked sheets on the upstream side of the separation roller 45*c* in the conveyance direction, that is, between the pickup roller 47*c* and the separation roller 45*c*.

<Document Stopper Opening/Closing Operation>

Figure 9A:
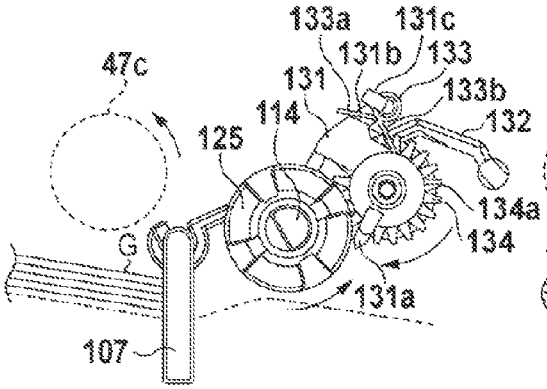
FIGS. 9A to 9E are views showing an operation of causing the stopper driving mechanism to open the document stopper.

FIGS. 9A to 9E are views showing an operation of causing the stopper driving mechanism to open the document stopper 107. Upon receiving a reading start instruction, the motor 17 (see FIG. 3) rotates in the forward direction. As shown in FIG. 9A, the separation roller gear 45*a*, the separation roller shaft 45*d*, the second separation roller shaft 114, and the stopper switching cam gear 125 rotate counterclockwise. The stopper opening/closing switching gear 134 receives the rotating force from the stopper switching cam gear 125, and rotates clockwise. The stopper opening/closing member 131 receives the rotating force via the biasing spring 133, and pivots clockwise. At this point of time, the stopper opening/closing member 131 is not in contact with the arm member 132. The frictional force between the arm portion 133*b* and the rotating boss portion 134*a* generates a torque for making only the stopper opening/closing member 131 pivot. Hence, the stopper opening/closing member 131 pivots.

Figure 9B:
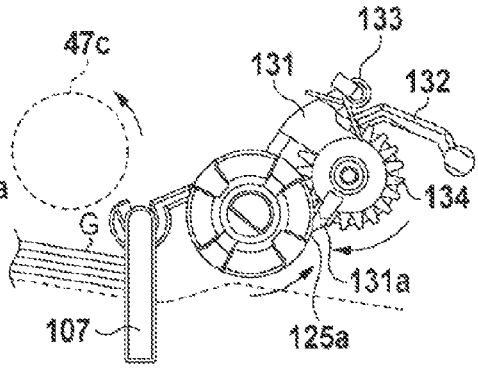

As shown in FIG. 9B, when the protruding portion 131*a* of the stopper opening/closing member 131 contacts the peripheral surface 125*a* of the cam of the stopper switching cam gear 125, the stopper opening/closing member 131 does not pivot any more. That is, since the arm portion 133*b* slides against the rotating boss portion 134*a*, the stopper opening/closing member 131 does not synchronize with the motion of the stopper opening/closing switching gear 134. At the timing the protruding portion 131*a* has contacted, the stopper opening/closing member 131 is not in contact with the arm member 132.

Figure 9C:
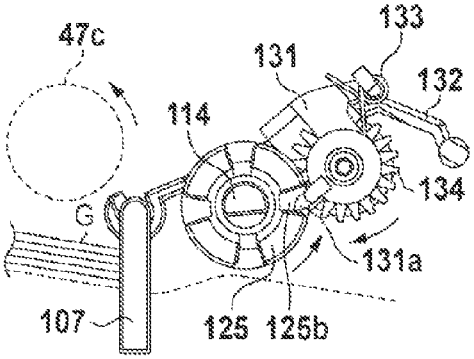

As shown in FIG. 9C, when the stopper switching cam gear 125 further rotates, and the protruding portion 131*a* of the stopper opening/closing member 131 reaches the groove 125*b* of the cam of the stopper switching cam gear 125, the stopper opening/closing member 131 receives the torque from the stopper opening/closing switching gear 134 via the biasing spring 133 and enters the groove 125*b*. After that, the stopper opening/closing member 131 contacts the arm member 132 from the lower side. To make the stopper opening/closing member 131 pivot, the torque for making the arm member 132 pivot via the stopper opening/closing member is required in addition to the torque for making the stopper opening/closing member itself pivot. The document stopper 107 also receives the load of the sheets stacked on the stacking table. For this reason, upon contacting the arm member 132, the stopper opening/closing member 131 does not pivot. Note that in this embodiment, the torque transferred by the biasing spring 133 almost equals the sum of the torque necessary for the pivotal movement of the stopper opening/closing member 131 itself and the torque necessary for the pivotal movement of the document stopper 107 to which the load of the arm member 132 and the sheets is not applied. If a larger pivotal load is applied to the stopper opening/closing member 131, the arm portion 133*b* slides against the rotating boss portion 134*a*, and the stopper opening/closing member 131 does not rotate.

Figure 9D:
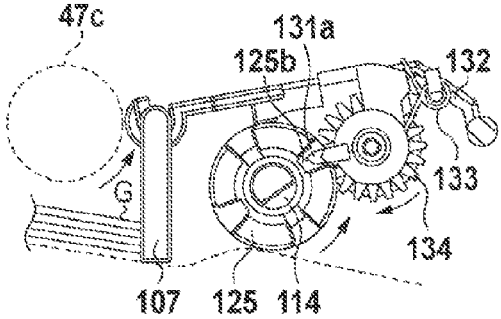

When the stopper switching cam gear 125 further rotates, and the protruding portion 131*a* contacts the wall of the groove 125*b*, the rotating force of the stopper switching cam gear 125 is transferred to the stopper opening/closing member 131 via the protruding portion 131*a* so that the stopper opening/closing member 131 starts pivoting clockwise again. Hence, as shown in FIG. 9D, the stopper opening/closing member 131 starts pushing the arm member 132 up from the lower side, and the document stopper 107 starts upward displacement. As the document stopper 107 moves upward, the pickup roller 47*c* starts moving downward.

Figure 9E:
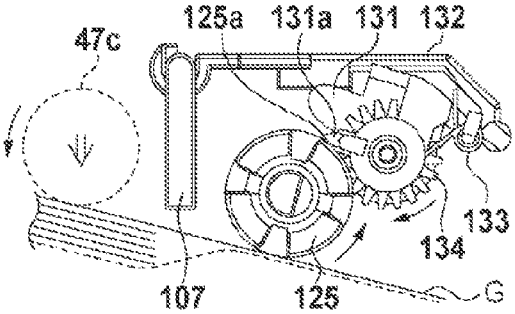

After that, as shown in FIG. 9E, the stopper switching cam gear 125 further rotates, and the protruding portion 131*a* of the stopper opening/closing member 131 comes out of the groove 125*b* of the stopper switching cam gear 125 (the locked state is canceled). Transfer of the rotating force from the stopper switching cam gear 125 to the stopper opening/closing member 131 via the protruding portion 131*a* thus stops. At this point of time, however, the document stopper 107 is already open, and the load of the sheets is not applied to the document stopper 107. For this reason, the document stopper 107 is continuously displaced upward by the torque transferred via the biasing spring 133. Upon abutting against the upper inner wall (paper feed cover 117) of the main body of the automatic feeding and reading apparatus 1 (reaching the top dead center), the arm member 132 stops the pivotal movement so as to hold the open state of the document stopper 107. At the top dead center, the stopper opening/closing member 131 and the stopper switching cam gear 125 are not in contact. When the document stopper 107 transits to the state that allows traveling of the document, the pickup roller 47*c* comes into contact with the document and feeds it.

The protruding portion 131*a* has a section where it waits while slidably contacting the cam face of the cam of the stopper switching cam gear 125 before engaging with the groove 125*b* of the stopper switching cam gear 125 such that the time after the document stopper 107 has transited to the state that allows traveling of the document until the pickup roller 47*c* contacts the stacked sheet is shortened as much as possible.

Figure 10A:
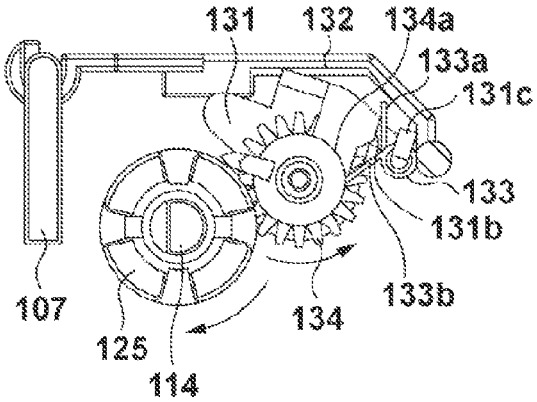
FIGS. 10A to 10E are views showing an operation of causing the stopper driving mechanism to close the document stopper.

FIGS. 10A to 10E are views showing an operation of causing the stopper driving mechanism to close the document stopper 107. As shown in FIG. 10A, when the motor 17 (see FIG. 3) is rotated in the reverse direction after the document reading operation has ended, and the document G has been discharged, the separation roller gear 45*a*, the separation roller shaft 45*d*, and the stopper switching cam gear 125 rotate clockwise. The stopper opening/closing switching gear 134 receives the rotating force from the stopper switching cam gear 125, and rotates counterclockwise. The stopper opening/closing member 131 receives the rotating force via the biasing spring 133, and pivots counterclockwise.

Figure 10B:
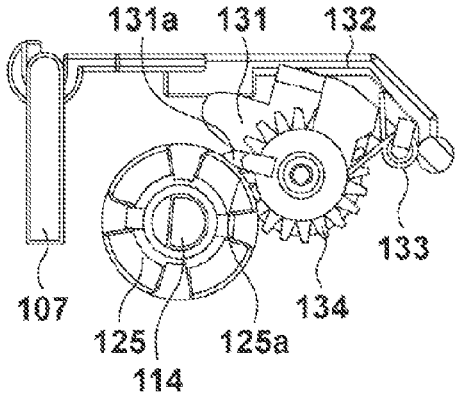

As shown in FIG. 10B, when the protruding portion 131*a* of the stopper opening/closing member 131 contacts the peripheral surface 125*a* of the cam of the stopper switching cam gear 125, the stopper opening/closing member 131 does not pivot any more.

Figure 10C:
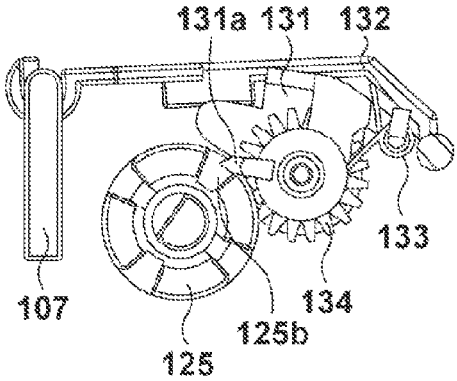
Figure 10D:
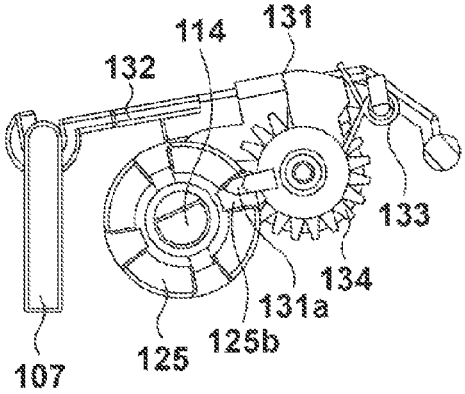

As shown in FIG. 10C, when the stopper switching cam gear 125 further rotates, and the protruding portion 131*a* of the stopper opening/closing member 131 reaches the groove 125*b* of the cam of the stopper switching cam gear 125, the protruding portion 131*a* enters the groove 125*b* due to the action of the biasing spring 133. When the groove 125*b* locks the protruding portion 131*a*, the stopper opening/closing member 131 receives the rotating force of the stopper switching cam gear 125 and starts pivoting counterclockwise. As shown in FIG. 10D, the arm member 132 falls toward the bottom dead center, and the document stopper 107 starts downward displacement. Note that in the operation of closing the document stopper 107, the load of the sheets is not applied to the document stopper 107. It is therefore possible to make the stopper opening/closing member 131 pivot by the action of the biasing spring 133 even without transfer of the rotating force of the stopper switching cam gear 125.

Figure 10E:
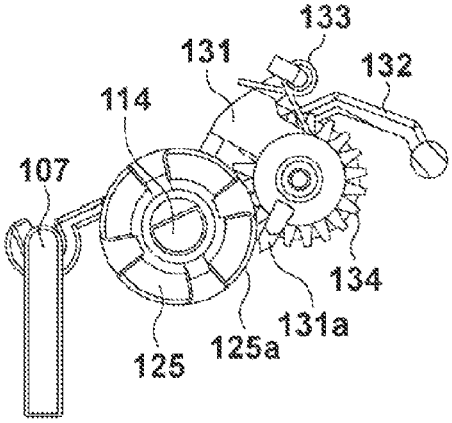

After that, as shown in FIG. 10E, the stopper switching cam gear 125 further rotates, and the protruding portion 131*a* of the stopper opening/closing member 131 comes out of the groove 125*b* of the stopper switching cam gear 125 (the locked state is canceled). Transfer of the rotating force from the stopper switching cam gear 125 to the stopper opening/closing member 131 via the protruding portion 131*a* thus stops. However, the document stopper 107 is continuously displaced downward by the action of the biasing spring 133. Upon abutting against the lower inner wall of the main body of the automatic feeding and reading apparatus 1 (reaching the bottom dead center), the arm member 132 stops the pivotal movement so as to hold the close state of the document stopper 107. At the bottom dead center, the stopper opening/closing member 131 and the stopper switching cam gear 125 are not in contact.

As described above, in this embodiment, when opening the document stopper 107, the stopper opening/closing member 131 is driven using the rotating force of the cam of the stopper switching cam gear 125 during the time the protruding portion 131*a* is locked by the groove 125*b*. During the time the protruding portion 131*a* is not locked by the groove 125*b*, the stopper opening/closing member 131 is driven via the biasing spring 133 using the rotating force of the stopper opening/closing switching gear 134.

Hence, according to this embodiment, the rotating force is transferred from the cam of the stopper switching cam gear 125 or the stopper opening/closing switching gear 134 to the stopper opening/closing member 131 in accordance with, for example, the magnitude of the load the sheets apply to the document stopper 107. It is therefore possible to more reliably open/close the document stopper 107.

In addition, the direction of the load the document stopper 107 supported by the arm member 132 receives from the sheets stacked on the stacking table is different from the direction of the load the arm member 132 receives from the stopper opening/closing member 131. For this reason, the driving load upon opening the document stopper 107 can be reduced while reducing the influence of the load of the sheets stacked on the stacking table.

Upon opening the document stopper 107, the protruding portion 131*a* enters the groove 125*b* when the stopper opening/closing member 131 contacts the arm member 132 from the lower side. That is, until the contact, the stopper opening/closing member 131 pivots due to the action of the biasing spring 133, and the protruding portion 131*a* enters the groove 125*b*. If the torque generated by the reaction force the stopper opening/closing member 131 that has contacted the arm member 132 from the lower side receives from the arm member 132 exceeds the torque in the reverse direction generated by the biasing force received from the biasing spring 133, the protruding portion 131*a* is locked by the groove 125*b*, and the stopper opening/closing member 131 is driven using the rotating force of the cam of the stopper switching cam gear 125. Otherwise, the protruding portion 131*a* is not locked by the groove 125*b*, and the stopper opening/closing member 131 is driven via the biasing spring 133 using the rotating force of the stopper opening/closing switching gear 134. This allows to more reliably drive the document stopper 107 supported by the arm member 132 independently of the load of the sheets and the like.

Since the document stopper 107 is made to pivot by extracting the rotating force from the separation roller shaft 45*d*, the opening/closing drive mechanism of the document stopper 107 can be implemented in an inexpensive space-saving design. Furthermore, the biasing spring 133 need only be able to apply the biasing force between the stopper opening/closing switching gear 134 and the stopper opening/closing member 131. Since no complex parts need be used, the opening/closing drive mechanism can be implemented at a low cost.

Moreover, since the stopper opening/closing member 131 and the stopper switching cam gear 125 are not in contact when the document stopper 107 has reached the top dead center or the bottom dead center, generation of operation noise can be suppressed.

Note that in the above embodiment, an example has been described in which the transfer means that is provided between the stopper opening/closing member 131 and the separation roller shaft to transfer the rotating force to the stopper opening/closing member 131 in accordance with the drive of the separation roller shaft includes both the first transfer means and the second transfer means. More specifically, the first transfer means includes the gear of the stopper switching cam gear 125 that rotates integrally with the separation roller shaft, the stopper opening/closing switching gear 134 provided adjacent to the separation roller shaft and fitted on the shaft 115 fitted in the stopper opening/closing member 131 so as to mesh with the stopper switching cam gear 125, and the biasing spring 133 that applies the biasing force between the stopper opening/closing switching gear 134 and the stopper opening/closing member 131. The second transfer means includes the cam of the stopper switching cam gear 125 that rotates integrally with the separation roller shaft and transfers the rotating force of the separation roller shaft to the protruding portion 131*a* protruding from the stopper opening/closing member 131. However, an arrangement including at least one of the first transfer means and the second transfer means can transfer the rotating force to the stopper opening/closing member 131 in accordance with the drive of the separation roller shaft.

For example, even when at least the load of sheets in number stackable on the stacking table (allowable number of sheets to be stacked) is applied to the document stopper 107, the biasing spring 133 is so rigid as to make the stopper opening/closing member pivot, the stopper opening/closing member 131 always move in synchronism with the stopper opening/closing switching gear 134. Hence, the transfer can be done only by the first transfer means. When the shape of the cam of the stopper switching cam gear 125 is changed to cause the cam face to lock the protruding portion 131*a* upon rotating the stopper switching cam gear 125, the transfer can be done only by the second transfer means. That is, when the distal end of the protruding portion 131*a* is always located on the pivotal orbit of the cam, the cam of the stopper switching cam gear 125 locks the protruding portion 131*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2010-293808, filed Dec. 28, 2010, which is hereby incorporated by reference herein in its entirety.

What is claimed is:

1. A sheet conveying device comprising:

a driving source;

a roller configured to feed stacked sheets;

a stopper member configured to close a conveyance path of the stacked sheets on a downstream side of the stacked sheets;

an opening member configured to open the stopper member;

a support member configured to support the stopper member;

a cam configured to move the opening member by a rotating force of the driving source, and a frictional clutch configured to transfer the rotating force of the driving source to the opening member, wherein:

the stopper member is supported on one end side of the support member, the support member is pivotably supported on another end side of the support member, the support member is disposed across and above the opening member, when the opening member is moved by the cam, the opening member moves the support member so that the stopper member opens the conveyance path, and the opening member is rotated using the rotating force transferred by the frictional clutch without using the cam in a state that a load of the stacked sheets is not applied to the stopper member.

2. The device according to claim 1, wherein when the rotating force necessary for moving the support member by a rotation of the opening member does not exceed the rotating force transferred by the frictional clutch the opening member moves the support member using the rotating force transferred by the frictional clutch without using the cam in a state that the load of the stacked sheets is not applied to the stopper member.

3. The device according to claim 1, wherein when the load of the sheets is not applied to the stopper member, the rotating force transferred by the frictional clutch can make the opening member pivot, and when the load of the sheets is applied to said stopper unit, said biasing member slides against said second gear and cannot make said opening member pivot.

4. The device according claim 1, wherein the opening member is disposed under the support member between the one end side and the other end side of the support member.

* * * * *